United States Patent [19]

Scott et al.

[11] Patent Number: 4,942,636

[45] Date of Patent: Jul. 24, 1990

[54] SPRING BEDDING PRODUCT

[75] Inventors: Terence A. Scott; Chester R. Yates, both of Carthage, Mo.

[73] Assignee: Leggett & Platt, Incorporated, Carthage, Mo.

[21] Appl. No.: 340,372

[22] Filed: Apr. 19, 1989

[51] Int. Cl.[5] ..... A47C 27/04; A47C 27/07

[52] U.S. Cl. ..... 5/475; 5/247; 5/260; 5/269; 267/91; 267/110

[58] Field of Search ..... 5/246, 247, 248, 255, 5/256, 260, 267, 269, 475, 476, 478; 267/91, 103, 110; 140/3 CA

[56] References Cited

U.S. PATENT DOCUMENTS

| | | | |
|---|---|---|---|
| 3,370,619 | 2/1968 | Docker | 140/3 CA |
| 3,472,290 | 10/1969 | Syjes et al. | 140/3 CA |
| 4,790,038 | 12/1988 | Ikeda | 267/91 |

FOREIGN PATENT DOCUMENTS

| | | |
|---|---|---|
| 1104884 | 3/1968 | United Kingdom . |
| 2143731B | 11/1986 | United Kingdom . |

*Primary Examiner*—Alexander Grosz

*Attorney, Agent, or Firm*—Wood, Herron & Evans

[57] ABSTRACT

A spring interior comprising a plurality of longitudinally extending bands of springs disposed side by side and connected together by helical lacing wires in the top and bottom faces of the bands. Each band of springs comprises a single length of wire formed into a plurality of substantially vertical coils of springs interconnected by interconnecting segments of wire located alternately in the top and bottom faces of the bands. Each interconnecting segment comprises a longitudinally extending bridging portion, a pair of transversely extending end portions, and a transversely extending support structure. The corners defined by the intersections between the bridging portions and the end portions of the interconnecting segments are radiused by radii of differing dimension so as to colinearly align the bridging portions of each band of springs. The support structure of the edgemost bands may be wrapped about the border wire to secure the border wire to the spring interior, and the end portion of the endmost interconnecting segments may be wrapped about the border wire for the same purpose.

21 Claims, 6 Drawing Sheets

SPRING BEDDING PRODUCT

This invention relates to spring interiors and, specifically, to spring interiors for bedding products, such as mattresses and the like.

A known form of spring interior comprises a plurality of longitudinally extending bands of springs disposed side by side and connected together by helical wires which extend transversely of the bands and embrace portions of the bands. Several kinds of bands of springs have been proposed for incorporation in spring interiors. One kind of band, which is the subject of British Pat. No. 1,104,884, will hereinafter be referred to as a band of interlocked springs. It comprises a single length of spring wire shaped to form a plurality of individual coil springs arranged in a row, one end turn of each coil spring lying adjacent to a top face of the band and the other end turn of each coil spring lying adjacent to a bottom face of the band, each coil spring being of a rotational hand opposite to the rotational hand of the adjacent coils immediately before and after it in the row, and being joined to the adjacent coil springs by a pair of interconnecting segments of wire integral with the coil springs. One of the pair of interconnecting segments is located in the bottom face of the band, and the other of the pair of interconnecting segments is located in the top face of the band. Each interconnecting segment comprises a bridging portion between adjacent coils, which bridging portion extends lengthwise of the row.

When bands of interlocked springs of the type described hereinabove, and more completely described in the above-identified British patent, are assembled together to form a spring interior, they are disposed side by side and interconnected by helical lacing wires, some of which lie in the top face of the spring interior and others of which lie in the bottom face thereof, the top and bottom faces of the spring interior being the faces defined by the top and bottom faces of the bands incorporated in the spring interior. Each helical wire extends across the bands of springs and embraces end portions of the interconnecting segments of the bands, which end portions extend transversely of the bands from the ends of the bridging portions. In the top face of the spring interior the helical wires are disposed at uniform intervals along the bands of springs, the arrangement being such that there are two springs disposed in the interval between each helical wire and the next. There is a similar arrangement in the bottom face of the spring interior.

The top face of a spring interior assembled in the manner described hereinabove has the general appearance of a rectangular grid. Each of the transverse elements of the grid comprises a helical wire, and each of the longitudinal elements of the grid comprises a row of mutually aligned bridging portions. Within the confines of each rectangle of the grid and disposed a little lower than the grid are the upper end portions of two adjacent coil springs, those two springs constituting parts of the same band of springs. The bottom face of the spring interior is, of course, similar to the top face, though inverted.

It is customary for a spring interior to be incorporated in an upholstered article. In such an article at least one of the main faces of the spring interior (that is, the top and bottom faces thereof) is covered by a layer or layers of padding. This in turn may be covered by a cover made of sheet material, such as ticking or upholstery fabric. In use, when pressure is applied to an upholstered face of such an article, the filling is pressed towards the spring interior, and in the absence of any additional support tends to enter the rectangular openings in the grid. When the thickness of the filling is relatively small as compared with the dimensions of each rectangular grid opening, the upholstery tends to be deformed in such a way that the pattern of the grid forms relatively unyielding ridges in the cover and can be felt by the user. This entry of the filling into the spring interior is a typical example of a phenomenon known in the trade as "cupping."

One method or technique of preventing or reducing "cupping" is described in British Pat. No. 2,143,731. As there described, a spring interior comprises a plurality of bands of interlocked springs wherein the bands are disposed side by side so that their top faces lie in a top main face of the spring interior and their bottom faces lie in a bottom main face of the spring interior. The bands of springs are interconnected by helical wires lying in the top and bottom faces of the bands and extending across the bands with each helical wire embracing portions of wires of the bands that extend transversely of the bands. The adjacent coils of each band are interconnected by interconnecting segments of the wire from which the band is formed. These interconnecting segments have bridging portions which extend lengthwise of the row of coils of the band and end portions which extend transversely of the bands. The bridging portions are shaped so as to extend not only longitudinally of the bands but also laterally thereof, the laterally extending portions constituting supporting structures for supporting padding and for preventing "cupping" of the padding. When padding or other upholstery material is disposed against a face containing those supporting structures, there is a reduction in any tendency there might otherwise be for the padding to enter the band through that face when forces are applied to the material in a direction or directions such as to compress the coil springs incorporated in the band.

All spring interiors heretofore made from bands of interlocked springs, including the spring interior described in British Pat. No. 2,143,731, are characterized by having bridging portions of the bands of springs extend slightly obliquely to the axes of the helical lacing wires. This characteristic derives from the fact that the transversely extending end portions of the interconnecting segments of these bands of wires are laced together by helical lacing wires and project out of the helical lacing wires on either side of the lacing wire. Because they project from opposite sides of the lacing wire, there is a tendency for one end portion to project out of one side of the helical lacing wire one-half pitch from the point at which the other end portion projects in the opposite direction from that same helical lacing wire. The result is that the end portions of the adjacent interconnecting segments connected by a common helical lacing wire emerge from the lacing wire one-half pitch from one another, and the attached bridging portions of the interconnecting segments of a band of springs are staggered or zig-zagged by one-half pitch of the lacing wire relative to one another. Otherwise expressed, the bridging portions are arranged slightly obliquely or angularly relative to the helical lacing wires. The result is a spring interior which is less durable because of the stresses created in the spring unit during deflection of the springs, which stresses effectively reduce the durability of the unit.

The staggering or zig-zag pattern of bridging portions of each band of springs of a spring interior has another deleterious effect upon that interior. It results in every adjacent pair of coil springs of each band being vertically misaligned or out of vertical alignment by one-half pitch of the helical lacing wire. Otherwise expressed, the vertical axes of each pair of adjacent coil springs in each band of springs are misaligned by one-half pitch of the helical lacing wire. This misalignment further contributes to the undesirable stresses imparted to the springs during deflection of the coil springs and the resulting lack of durability of the spring interior. It also results in the lower longitudinally extending side edge of the spring interior being out of vertical alignment with the upper edge on the same longitudinally extending side edges of the spring interior.

Another characteristic of the spring interior described in British Pat. No. 2,143,731, as well as all spring interiors heretofore made from bands of interlocked springs, is that the bridging portions of the interconnecting segments between adjacent springs in one face, e.g. the bottom face, of the spring unit are offset by approximately one spring diameter from the interconnecting segments in the other face, e.g. the top face, of the spring unit. As a consequence of this offset relationship of the interconnecting segments, the endmost interconnecting segments in one face of the spring unit terminate in one-half of an interconnecting segment, while the endmost segment in the other face terminates in a full interconnecting segment. It is desirable that the length of wire contained in the half-length interconnecting segment be sufficient to form an attachment for fixing the endmost portion of the interconnecting segment to the perimeter or border wire which surrounds each face of the spring unit and still locate that border wire immediately above or below the other border wire attached to the full-length interconnecting segment. Because the formed half-length of the interconnecting segment in one face is generally not exactly one spring diameter in length, the border wire connected to that half-length of interconnecting segment is generally not parallel to or located immediately above or below the other border wire.

Still another characteristic of the spring interior described in British Pat. No. 2,143,731, as well as very nearly all spring interiors heretofore made from bands of interlocked springs, is that they have the border wire clipped or sewn by a helical wire to the endmost or edgemost interconnecting segments of the bands of springs. This practice of using metal clips or helical wires to connect the perimeter wire to the edgemost connecting segments of the bands of springs is expensive and oftentimes results in excessive noise as the border wire moves relative to the connected interconnecting segment.

It has been one objective of this invention to eliminate the stresses created by the staggering of the bridging portions of a common band of interlocked springs which results from the end portions of commonly laced interconnecting segments emerging one-half pitch apart along the length of the common lacing wire.

Still another objective of this invention has been to provide an improved spring interior made from bands of interlocked springs in which the staggering or offsetting of the bridging portions of the interconnecting segments between adjacent springs of the bands are eliminated after lacing of adjacent bands by helical lacing wires.

Still another objective of this invention has been to provide an improved spring interior construction and method of forming the spring interior wherein the border wire which connects to the half-length interconnecting segment of a band of springs is located immediately above or below and parallel to the border wire of the other face which connects to the full-length interconnecting segment of a band of springs.

Still another objective of this invention has been to provide an improved means for connecting the border wire to a spring interior made from bands of interlocked springs.

In order to overcome the natural zig-zag or offset configuration of the bridging portions of bands of interlocked springs which results from the interconnecting segments emerging on opposite sides of a common helical lacing wire one-half pitch apart, the invention of this application employs interconnecting segments in which each band of springs has the interconnecting segments shaped with radii of different dimensions at the corners or intersections between the bridging portions and the end portions of interconnecting segments. By providing substantially differing radii at the two corners of the interconnecting segment formed by the intersection of the bridging portion and the two end portions, the bridging portions of adjacent commonly laced interconnecting segments are axially aligned even though the end portions of those interconnecting segments project from the common lacing helical half a pitch apart along the length of the helical lacing wire. These differing radii "make up" the half-pitch difference in projection, and thus permit the bridging portions of the interconnecting segments to be colinearly aligned and located perpendicular to the axes of the helical lacing wires. Not only does this difference in radii enable the bridging portions of a band of springs to be colinearly aligned and located perpendicular to the helical lacing wires, but it also corrects the misalignment of the vertical axes of adjacent pairs of coil springs of a common band of springs which had heretofore characterized the prior art. The result is an assembled spring interior which is not subject to excessive stresses when the unit is deflected and which therefore is much more durable than prior art spring interiors formed from bands of interlocked springs. This modification also results in the longitudinal side edges of the spring interior being vertically aligned with one another on the top and bottom faces of the spring interior.

In order to overcome the problem of misaligned upper and lower border wires resulting from half-length interconnecting segments being connected to a border wire in one face of the spring unit and full-length interconnecting segments being connected to the border wire in the other face, the spring interior of this invention employs an interconnecting segment in one face which is severed at a point half way along its length and formed into a shape conducive to attachment to the border wire. In order that that border wire which is attached to the half-length interconnecting segment may be parallel to and located immediately above or below the border wire in the other face, an adjustment to the length of the interconnecting segment located immediately adjacent to the half-length interconnecting segment is made. This adjustment is made by flattening the supporting structure of the other bridging portions of the interconnecting segment in the face of the band of springs containing the half-length bridging segment. Alternatively, others of the bridging portions of interconnecting segments in the other face may be shortened by gathering in the supporting structure of bridging portions of interconnecting segments in that other face such that the overall length of the bands in both faces are identical and the border wires in one face overlie or underlie the border wire in the other face. In practice, any number of adjustments in the length of the interconnecting segments may be made by flattening or gathering in the supporting structure of one or more bridging portions of the bands so as to extend or reduce the face length of the bands of springs so as to locate one border immediately over the other and maintain the parallelism of the border wires.

In the practice of this invention, the perimeter or border wire may be fastened to the edgemost or endmost bands of springs by wrapping a laterally extending portion of the interconnecting segment of the bands of springs about the perimeter wire. Additionally, the perimeter or border wire may be fastened to the springs on the end of the band of springs by wrapping a section of the end portion of the interconnecting segment about the perimeter wire. And, in one preferred embodiment, the perimeter wire is fastened to the endmost interconnecting segment of the band of springs by twisting the formed half-length of the bridging portion about the perimeter wire.

In accordance with the practice of this invention, the spring interior comprises a plurality of bands of springs, each band of which comprises a single length of wire shaped to form a plurality of individual coil springs arranged in a longitudinal row with one end turn of each coil spring lying adjacent to a top face of the band, and the other end turn lying adjacent to a bottom face of the band. Each coil spring is joined to the adjacent coil springs by interconnecting segments integral with the coil springs such that one of the interconnecting segments is located substantially in the top face of the band, and the other of the interconnecting segments is located substantially in the bottom face of the band. Each interconnecting segment comprises a bridging portion which extends longitudinally of the row and end portions which extend transversely of the rows. The bands are disposed side by side so that their top faces lie in a top main face of the spring interior and their bottom faces lie in a bottom main face of the spring interior. The bands are interconnected by helical lacing wires lying in the top and bottom faces of the bands and extending across the bands with each helical wire embracing adjacent end portions of the interconnecting segments of the bands. According to the practice of this invention, each of the bridging portions of the interconnecting segments are connected at the ends to end portions of the interconnecting segments by radiused corners of substantially different radii so as to position adjacent bridging portions in substantially longitudinal alignment perpendicular to the helical lacing wires. In the preferred practice of this invention, the bridging portions of the edgemost bands of springs are connected to the border wire by wrapping laterally extending portions of the bridging portions about the border wire and by wrapping of the endmost end portions of the interconnecting segments of the bands of springs about the border wire. Additionally, the preferred embodiment of the invention is characterized by the endmost bridging portions of the bands being severed at the midpoint of the endmost bridging portion of the band and being connected at the severed end to one of the border wires in one of the main faces of the spring interior, and others of the bridging portions of springs containing that midpoint severed bridging portion having the laterally extending portion of the bridging portion altered in configuration to change the length of those other bridging portions to thereby conform the overall length of the band in one main face of the spring interior to the length of the band in the other face.

The advantage of a spring unit which has the bridging portions of the interconnecting segments of a band of interlocked springs colinearly aligned and perpendicular to the connecting helical lacing wires is that all of the coil springs of each band of coil springs have their vertical axes aligned, and less stress is imparted to the springs and the lacing wires than has heretofore been imparted to prior art interiors made from bands of interlocked springs. As a result, the spring unit is much more durable than comparable prior art spring units. As an example, simply changing the configuration of the interconnecting segments of the bands of interlocked springs in the manner described above has been found to impart as much as 40 percent greater durability to the spring unit than a comparable unit made without this change of configuration.

Additionally, this spring unit has been found to be more stable under load and to conform better to the contours of a body lying atop the unit than a spring unit made without this change of interconnecting segment configuration.

Yet another advantage of a spring unit made in accordance with the disclosure of this application, and particularly one which has the bridging portions of the interconnecting segments perpendicular to the helical lacing wires, is that the unit folds more easily and with less stress to the springs than prior spring units made from bands of interlocked springs. This characteristic is particularly advantageous when the spring unit is used as a mattress of a sofa sleeper.

Yet another advantage of a spring interior made in accordance with the disclosure of this application, and particularly one in which the interconnecting segments of the bands of springs are adjusted in length by either extending or gathering in the supporting structure of the bridging portion of the band of springs, is that it enables the upper border wire to be located immediately above and parallel to the lower border wire without any offset between the top and bottom faces of the spring unit such as has often characterized prior art spring interiors. The result is a spring unit in which the top and bottom faces of the unit are square and therefore more easily covered with ticking or upholstery than prior art spring interiors.

And yet another advantage of a spring interior made in accordance with the invention of this application, and particularly one which utilizes laterally extending supporting structures of the bridging portion of the interconnecting segments to secure the bands of springs to the border wire, or which utilizes either half-length or full-length end portions of the interconnecting segment to secure the bands of springs to the border wire, is that the spring unit is less expensive to manufacture and less noisy than prior art spring interiors wherein the springs were formed from bands of interlocked springs and connected to the border wires by lacing wires or metal clips.

In this description of the invention there are references to faces of bands of springs and of spring interiors.

As the bands of springs and spring interiors are, of course, of openwork or skeletal form, the term "face" must be understood as referring to an imaginary surface defined by the relevant parts of the bands or spring interiors. Furthermore, as the wires and helical wires are of finite width or thickness and as they sometimes overlap each other, the term "face" cannot be understood as having a strictly geometrical meaning. Nevertheless, as the faces concerned are relatively extensive and are of flat shape, their locations can in practice be determined without difficulty or ambiguity.

These and other objects and advantages of this invention will be more readily apparent from the following description of the drawings in which.

Figure 1:
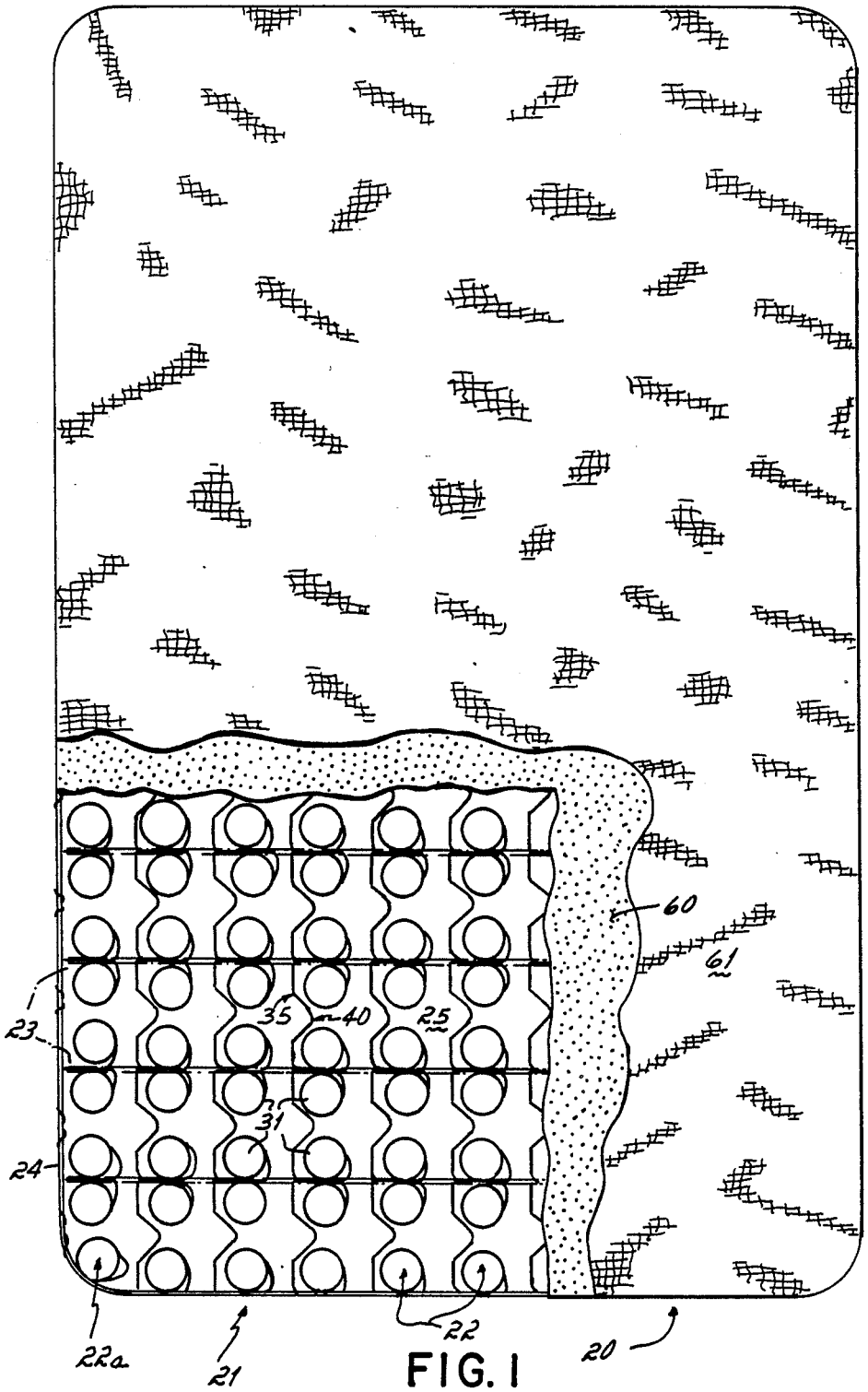
FIG. 1 is a top plan view, partially broken away, of a mattress incorporating the invention of this application.

With reference first to FIGS. 1–6, there is illustrated a mattress 20 embodying the invention of this application. This mattress 20 comprises a spring interior 21 formed from a plurality of bands of springs 22 which extend longitudinally of the mattress. These bands of springs 22 are laced together by helical lacing wires 23 which extend transversely of the spring interior and secure the bands of springs in an assembled relation. Border wires 24 extend completely around the periphery of the spring interior in the top and bottom faces 25, 26, respectively, of the interior and are secured to the outermost edge of the spring interior in these planes by novel connecting means 27, 27' and 28.

Figure 4:
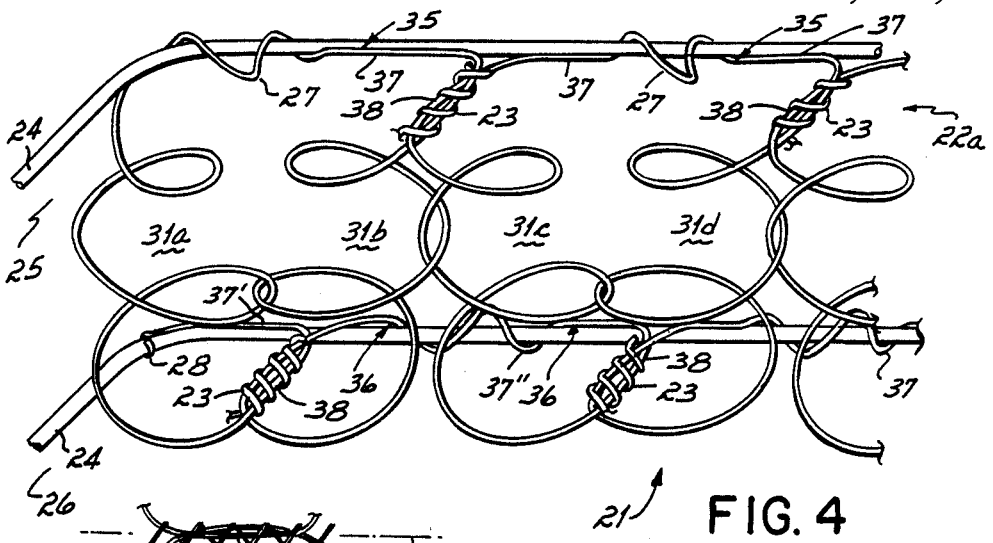
FIG. 4 is a perspective view of a portion of one band of springs of the spring interior of FIGS. 1–3.
Figure 6:
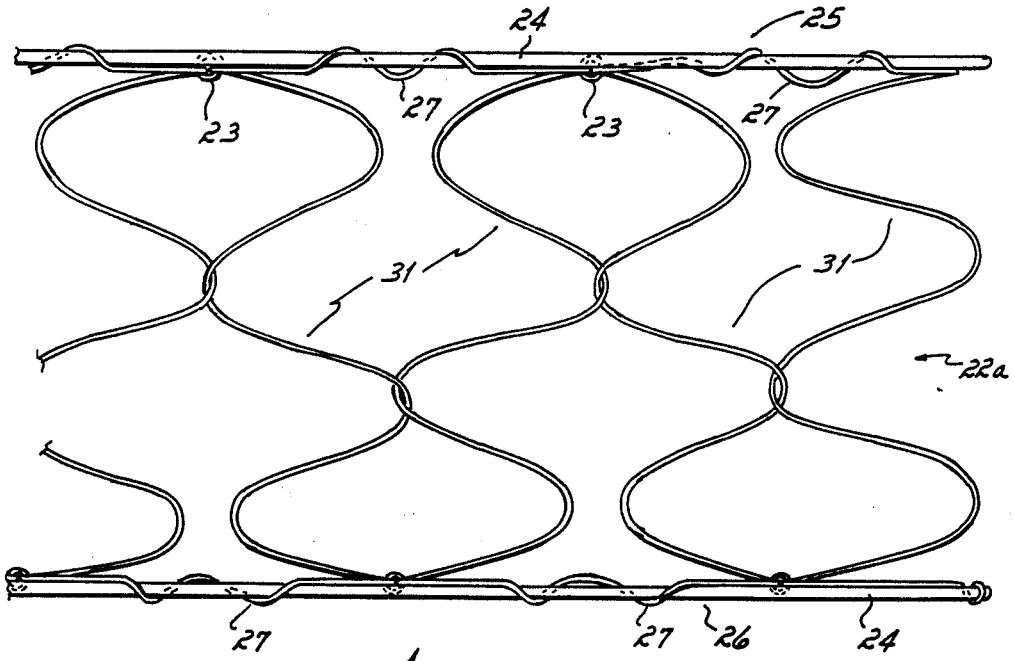
FIG. 6 is a side elevational view of the spring unit taken on line 6—6 of FIG. 2.
Figure 7:
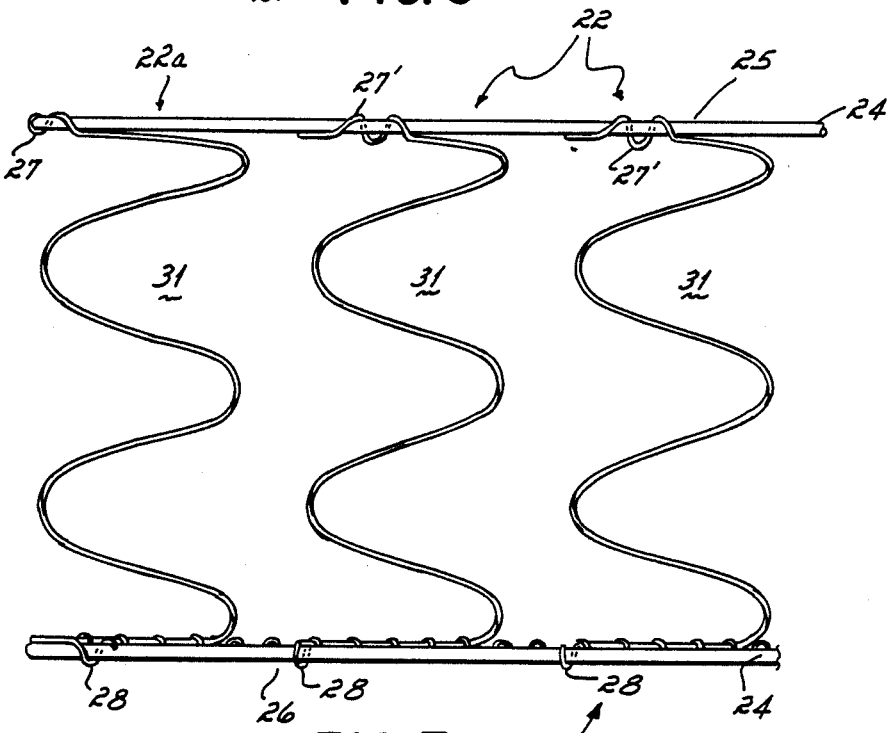
FIG. 7 is an end elevational view taken on line 7—7 of FIG. 2.

Each band of springs 22, a portion of one of which is illustrated in FIG. 4, is made from a single length of spring wire shaped to form a plurality of individual coil springs 31 arranged in a row. Each coil spring 31 comprises about two and one-half turns of wire. The axis of each coil spring is not upright but is inclined lengthwise of the band (as best illustrated in FIG. 6), each spring 31 being inclined in a direction opposite to that in which its two immediate neighbors in the row are inclined. The end turns of the coil springs 31 lie adjacent to the top and bottom faces 25, 26 of the band. Each coil spring, such as that numbered **31*b*, is so coiled as to have a hand opposite to the hand of the adjacent coil springs, such as 31*a* and 31*c*, immediately before and after it in the row. Each coil spring is joined to the next adjacent coil springs by two interconnecting segments 35, 36 of the wire integral with the coil springs. One of the two interconnecting segments 35, 36 is in the top face 25 of the band 22, and the other is in the bottom face 26 thereof. For example, coil spring 31*a* is connected to coil spring 31*b* by interconnecting segment 35, which is in the top face of the band, and the coil spring 31*b* is connected to coil spring 31*c* by interconnecting segment 36, which is in the bottom face of the band. Each interconnecting segment 35, 36 comprises a bridging portion 37, which extends longitudinally of the row of coil springs, and end portions 38, which extend in a direction normal to the longitudinal axis of the band 22. Those end portions 38 of the interconnecting segments 35, 36 also lie in the top and bottom faces 25, 26 of the band 22**.

Figure 2:
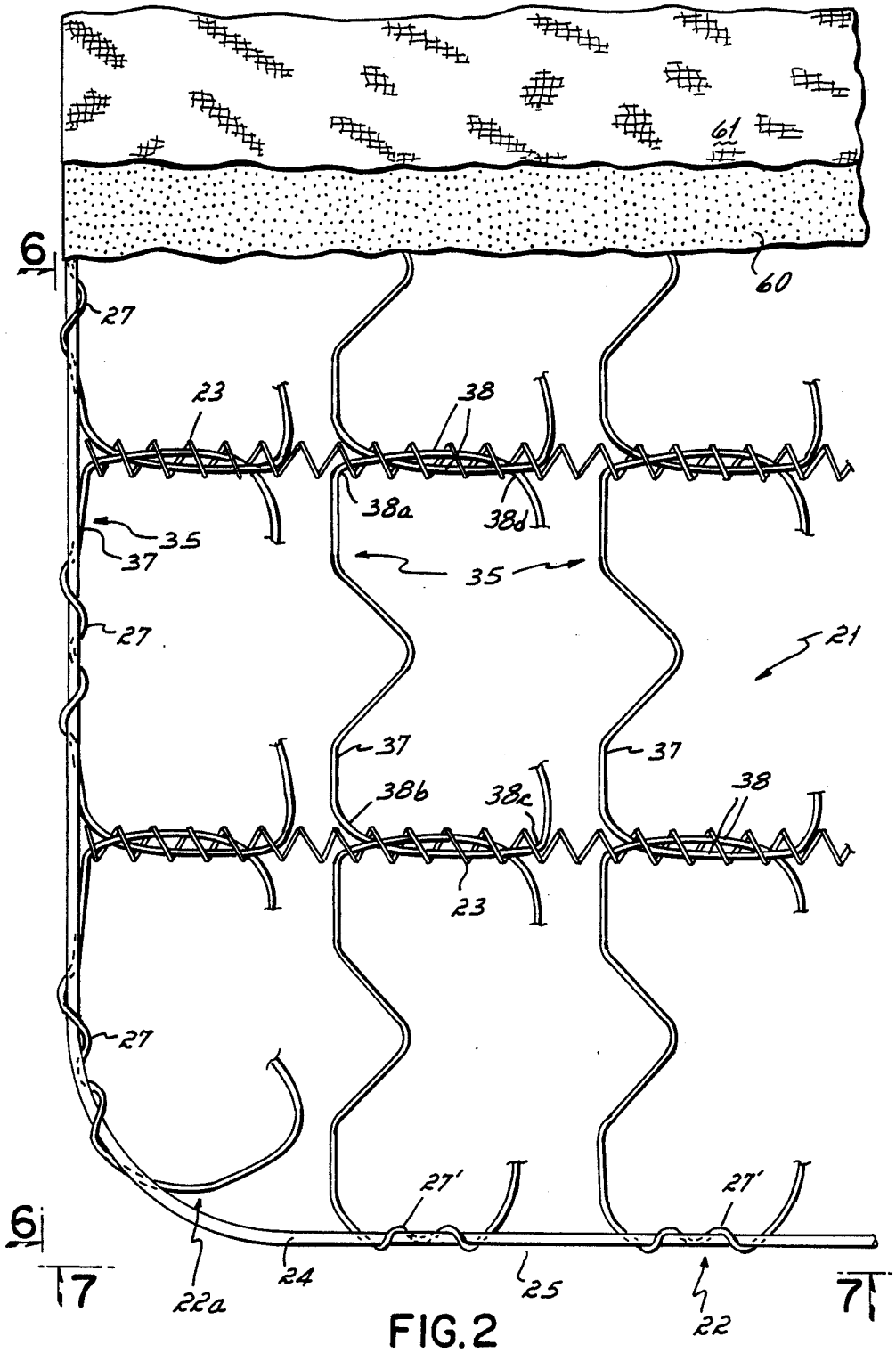
FIG. 2 is an enlarged top plan view of a corner portion of the mattress of FIG. 1.

The intersections of the end portions 38 of the interconnecting segments 35 are all radiused as may be most clearly seen in FIGS. 2 and 4. In the past, these radiused intersections or corners **38*a*, 38*b*, 38*c* and 38*d* of interlocked bands of springs have all been of the same radius. The invention of this application, though, departs from prior art practice in that each bridging portion 37 is connected to the end portion 38 at its opposite ends by radiused corners 38*a*, 38*b* of substantially different radii. The drawings illustrate these radii differences greatly exaggerated, but in one preferred embodiment of this invention, the radius 38*a* between one end portion and one end of the bridging portion 37 is one-quarter of an inch, while the intersection 38*b* between the other end of the bridging portion and the end portion 38 is five-eighths of an inch. Similarly, the intersections 38*c* and 38*d* between the end portions and the coil springs 31 to which they are connected differ in radius. The intersection 38*c* diametrically opposite from the intersection 38*a* is of the same radius as the intersection 38*a*, i.e., one-quarter inch in the preferred embodiment, and the other intersection 38*d* is of the same radius as the diametrically opposite intersection 38*b*, i.e., five-eighths inch in the preferred embodiment. These differing radii are very significant to one aspect of this invention because they enable the bridging portions of a single band of springs to be longitudinally aligned with one another when the spring interior is assembled and the bands are interlaced by the helical lacing wires 23. These differing radii also function to enable the bridging portions 37 to be aligned perpendicular or normal to the helical lacing wires 23, rather than being skewed relative thereto as has been the practice in the prior art. Additionally, these differing radii enable the vertical axes of all of the coils of springs of a band of springs to be vertically aligned with one another when viewed in the longitudinal direction of the band rather than being vertically skewed as has been characteristic of prior art spring interiors made from interlocked bands of springs. This improved alignment of the bands of springs which results from the differing radii of the interconnecting segments of the bands is explained more fully hereinafter in connection with the assembly of the spring interior 21**.

Each bridging portion 37, in addition to extending longitudinally of the band, also extends laterally thereof to form a supporting structure 40. In the embodiment of FIGS. 1–7, the supporting structure 40 is shaped in the form of an inwardly extending V lying in the top 25 or bottom face 26 of the band 22, as the case may be, and extending to one side of the remainder of the bridging portion 37 of which it forms a part. Each V-shaped supporting structure 40 lies half way between the end portions 38 of the interconnecting segment of which it forms a part, and it extends approximately half way across to the other side face thereof. Each V-shaped supporting structure includes an arcuate central part 42 connected at its opposite ends to diverging arms 43, which are in turn connected to the end portions 38.

Figure 3:
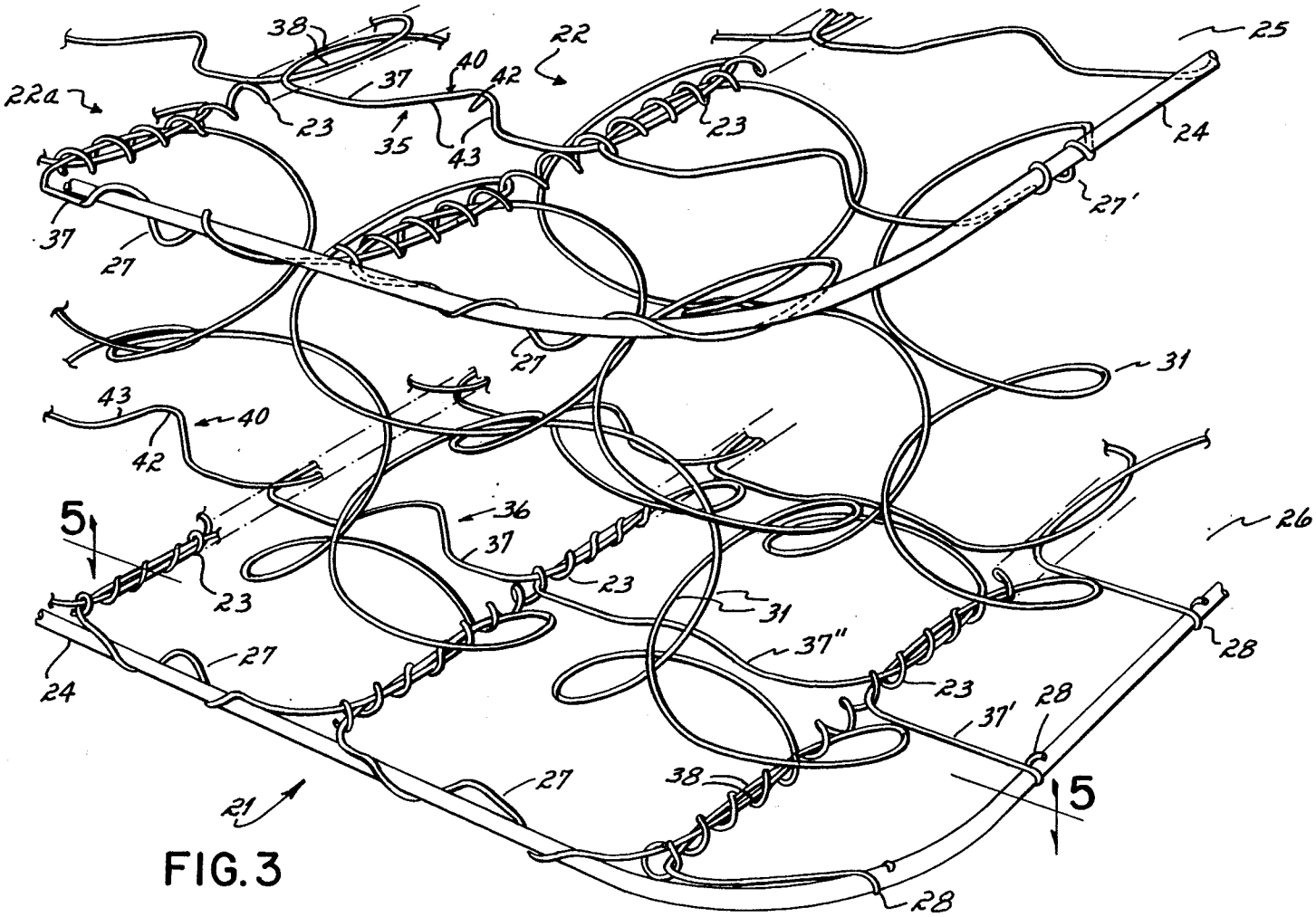
FIG. 3 is a perspective view of the same corner of the mattress of FIG. 1 as is illustrated in FIG. 2.

Again, with particular reference to FIGS. 3 and 4, it will be seen that the supporting structure 40 of the edgemost bands of springs 22*a*, rather than extending inwardly toward the opposite side of the band, are wrapped as at 27 about the border wire 24 which extends parallel to and rests against the bridging portions 37 of the outermost band. The depth of the V shape of the supporting structure 40 is sufficient in the preferred embodiment of this invention to enable the V-shaped supporting structure 37 to make slightly more than one full wrap about the border wire, and thereby secure the border wires to the top and bottom faces of the spring interior by the connecting means 27 formed from the supporting structure 40.

With particular reference now to FIG. 2, it will be seen that the endmost end portions 38 of each band of springs in the top face is secured to the border wire by wrapping of that endmost end portion 38 about the border wire to form an end connecting means 27'. This connecting means 27' also forms approximately one full wrap about the border wire 24.

Figure 5:
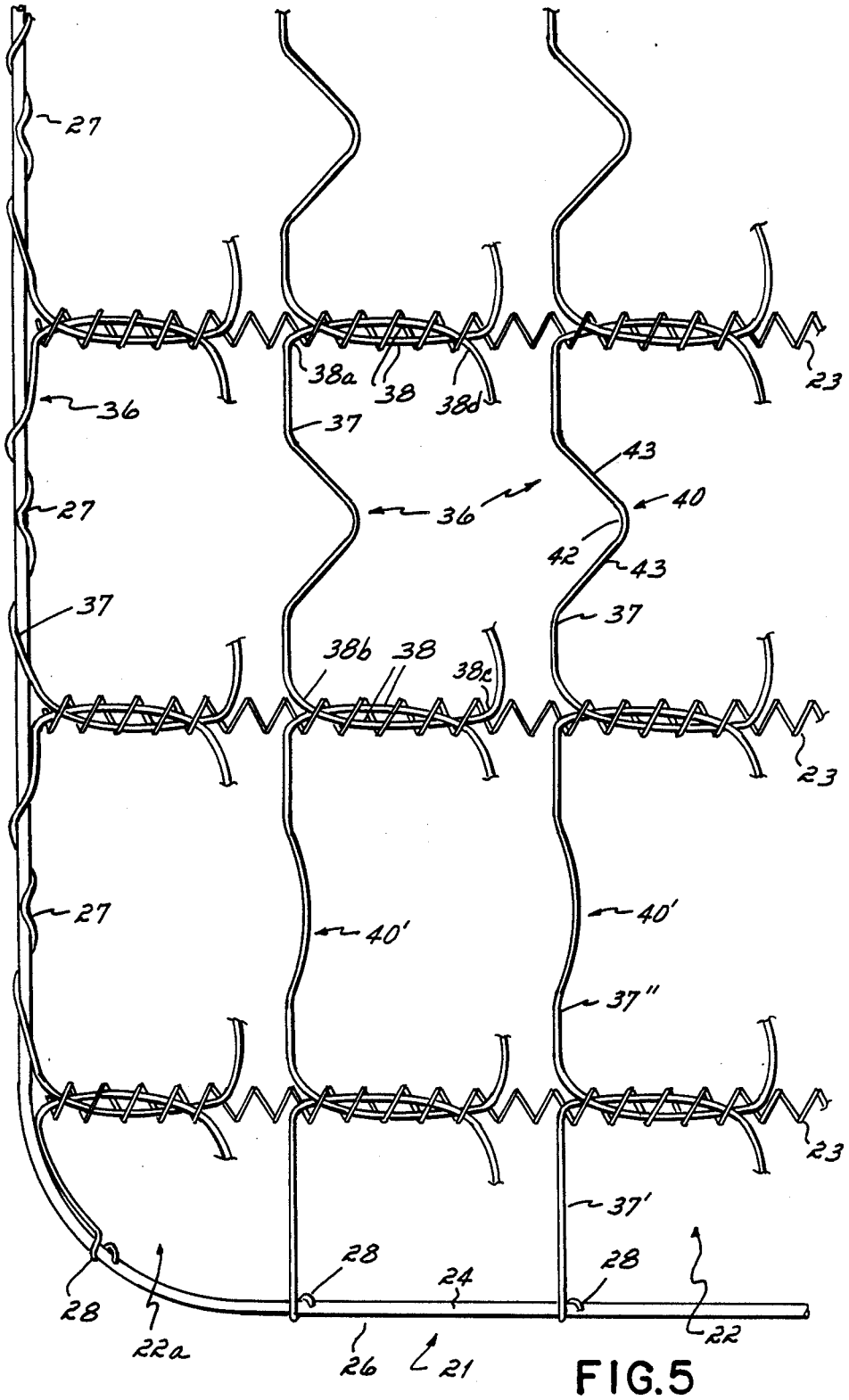
FIG. 5 is a cross-sectional view taken on line 5—5 of FIG. 3 illustrating the configuration of the bottom face of the spring unit of FIG. 1.

With reference now to FIGS. 4 and 5, it will be seen that the ends of each band cannot be connected to the bottom border wire in the bottom face of the spring interior in the same manner as the border wire is connected to the ends of the bands 22 in the top face because the endmost lower interconnecting segment 36 of each band of springs is offset by the diameter of one spring 31 from the endmost interconnecting segment 35 in the top face of the spring interior. Consequently, in order to have the border wire 24 of the top face located immediately above the border wire 24 in the bottom face, only one-half of a bridging portion 37 is present at the lower end of each end of each band 22 of springs. In order to connect that half length interconnecting segment to the border wire, the endmost bridging portion 37 in each band of springs is severed at the midpoint of the bridging portion and is straightened to form an endmost half-length bridging portion 37', the end of which is wrapped about the border wire 24. That end forms a connecting means 28 between the end of each band of springs and the border wire 24 in the bottom face of the spring interior 21. That connecting means 28 may be welded or otherwise fixed to the border wire in order to prevent lateral movement of the band relative to the border wire.

Because the half-length of the interconnecting segment 37 may be insufficient in length to position the bottom border wire immediately beneath the top border wire so as to form a square end on the spring interior 21, the invention of this application contemplates that the supporting structure 40 may be lengthened by flattening the band, as illustrated in the bridging portion 37'' in the transverse row of bridging portions located immediately adjacent to the half-length bridging portion 37'. Alternatively, the length of the bands of springs may be altered by gathering or moving the diverging legs 43 of the V-shaped supporting structure toward one another. In the practice of this invention, though, lengthening of the band is generally required in order to position the bottom border wire immediately beneath and in the same vertical plane as the top border wire. This is accomplished by flattening the V-shaped supporting structure 40' in the transverse row 37'' of bridging portions located immediately adjacent to the endmost half-length bridging portions 37'.

The method of manufacturing and the apparatus for manufacturing the band of springs illustrated in FIG. 4 is completely described and illustrated in British Pat. No. 2,143,731. After the rows of coil springs are formed, each coil spring is coupled with the next by having an intermediate turn thereof passed around an intermediate turn of the next spring. This coupling can be carried out mechanically or manually. The coil springs 31*a*, 31*b*, 31*c* and 31*d* illustrated in FIGS. 4 and 6 are coupled in this manner.

A plurality of bands of springs 22 are assembled to form a spring interior 21. Bands of springs 22, each similar to that shown in FIGS. 1–4, are disposed side by side, and preformed helical wires 23 are attached to them. The helical wires 23 lie in the top and bottom faces 25, 26 of the bands and extend at right angles to the longitudinal axes of the bands. Each helical wire 23 embraces one pair of closely adjacent end portions 38 of each band.

It will be seen from FIG. 3 that much of the top and bottom faces of the spring interior has the general appearance of a rectangular grid. Each of the transverse elements of the grid comprises a helical wire 23 with the end portions 38 embraced by it, and each of the longitudinal elements of the grid comprises a row of mutually aligned bridging portions 37. Within the confines of each rectangle of the grid and disposed a little lower than the grid are the upper end portions of two adjacent coil springs 31. Were it not for the presence of the supporting structure 40, the top face 25 and bottom face 26 of the spring interior 21 would present relatively large rectangular apertures into which upholstery material, such as filling or padding 60 (FIG. 1), placed on top of the top face could readily enter, thereby giving rise to "cupping." The presence of the supporting structure 40, however, reduces any tendency to "cupping," as the supporting structures occupy central parts of the rectangular apertures and can serve to support the upholstery material. And this same supporting structure 40 functions in the case of the two edgemost bands to tie the border wire 24 to the spring interior 21 on the side of the spring interior 21 when the supporting structure 40 of the edgemost bands is wrapped about the border wire.

Figure 8:
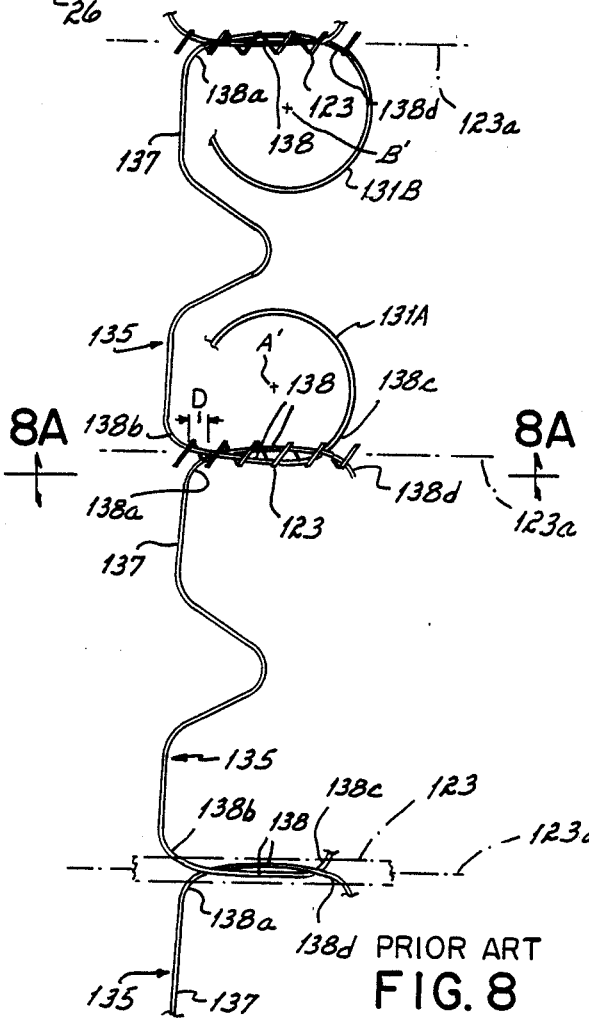
PRIOR ART FIG. 8
FIG. 8 is a top plan view of a band of interlocked springs manufactured and assembled in the manner of the prior art.

With particular reference to FIGS. 2 and 8, there is illustrated the advantage of the differing radius corners 38*a*, 38*b* of the interconnecting segment of the spring bands of this invention relative to the prior art spring bands. Specifically, first with reference to FIG. 8, there is illustrated the position assumed by the adjacent interconnecting segments of a band of springs manufactured and assembled in the manner of the prior art, as for example, in the manner of British Pat. No. 2,143,731. Because the radii 138*a*, 138*b* of the prior art interconnecting segments 135 were identical in radius and because the end portions 138 of adjacent interconnecting segments 135 were laced together by a common helical lacing wire 123, the end portions 138 emerged from the lacing wire a distance D apart equal to approximately one-half pitch of the lacing wire 123. As a result of this natural tendency of the interconnecting segments to assume this skewed position wherein one end of the interconnecting segment extended laterally beyond the other end, the adjacent bridging portions 137 of the prior art band of springs were skewed or angled relative to the adjacent bridging portions. The result was that the bridging portions created a zig-zag pattern along the length of the band of springs, rather than being parallel or in longitudinal alignment with one another. This is not the position illustrated in the prior art patents, but it is the position which the bridging portions 135 of prior art spring interiors naturally assume when assembled because the radii 138*a* and 138*b* of the prior art interconnecting segments are identical and connected by helical lacing wires. As a consequence of this skew or misalignment of the bridging portions 137, the bridging portions 137 are angled slightly relative to the axes 123*a* of the helical lacing wires. The result of this skew of the bridging portions relative to the lacing wires is that a stress point is created at the intersection of the bridging portions and the lacing wire when the springs are deflected, which stress point is subject to wear and eventual premature breakage.

Figure 8A:
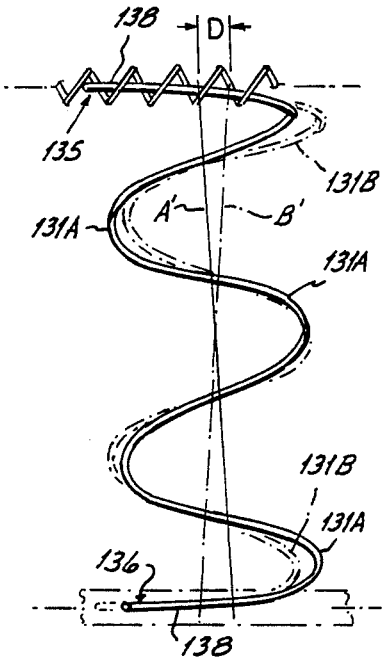
PRIOR ART FIG. 8A
FIG. 8A is a cross-sectional view taken on line 8A—8A of FIG. 8 in which the nearest of a pair of coil springs is shown in solid lines and the furthest is shown in phantom lines.

FIG. 8A illustrates another problem created by the skew or zig-zag pattern of the bridging portions of bands of interlocked springs made in accordance with prior art practice. Because of the one-half pitch offset of the adjacent interlaced end portions 138 of the interconnecting segments 135, 136, the vertical axes of adjacent coil springs 131 of each band of springs are misaligned by that same one-half pitch D. As a result, the vertical axes of each coil spring 131 is inclined relative to the vertical axis of the adjacent coil spring of the same band of coil springs. This inclination is illustrated in FIG. 8A where one coil spring 131A at one end of an interconnecting segment 135 (FIG. 8) is illustrated in solid lines, and the adjacent coil spring 131B at the opposite end of this same interconnecting segment 135 is shown in phantom lines. As there illustrated, the vertical axis A' of the coil 131A is inclined relative to the axis B' of the coil 131B. As a result of this inclination, stresses are imparted to the coil springs when they are deflected, and the durability of the spring interior employing such tilted or skewed coils is reduced. Another adverse consequence of this relative tilting of the vertical axes of adjacent coils of each band of coils made in accordance with prior art practice is that spring interiors having these vertically skewed coils have misaligned longitudinal side edges. Otherwise expressed, one longitudinal side edge in the top plane of the spring interior will not overlie the corresponding longitudinal side edge in the bottom plane.

With reference now to FIG. 2 where the invention of this application is illustrated, it will be seen that as a consequence of the differing radii 38*a* and 38*b* of the interconnecting segments 35 of the bands of spring of this invention, the adjacent end portions of the interconnecting segments emerge from the lacing wire 23 on opposite sides of the lacing wire and approximately one-half pitch length apart. But because of the differing radii, the longitudinally extending bridging portions 37 of adjacent interconnecting segment all are colinearly aligned. And, because the bridging portions are all colinearly aligned, those bridging portions all extend perpendicular to the axes of the helical lacing wires 23, and the vertical axes of all coil springs in each band of springs are all vertically aligned when viewed in the longitudinal direction of the band. As a result of this alignment, many of the stresses which are characteristic of prior art spring interiors—particularly at the intersection of the lacing wires and the interconnecting segments—are eliminated. In practice, the elimination of these stresses has been found to increase the durability of a spring unit made in accordance with the invention of this application by as much as 40 percent over a spring unit of similar construction, but with common radii intersections. The construction of this invention with its aligned bridging portions and its perpendicularity of those bridging portions relative to the axes of the lacing wire has also been found to be particularly advantageous for use in mattresses of sofa sleepers wherein the borders wires are omitted or hinged, and the mattress is subject to folding about a transverse fold line.

The spring interiors described hereinabove can be incorporated in an article, such as an upholstered mattress or seat. Irrespective of the item of furniture in which the spring interior 21 is placed, one or more layers of padding or filling 60 are generally placed across the top end or bottom face of the spring interior and covered with a suitable cover material 61.

In addition to being more durable than prior art spring interiors made from bands of interlocking springs, the unique spring interior 21 of this invention has been found to be more stable under load and to better conform to the contours of a body resting atop the interior 21.

The invention of this application also results in a more perfectly squared spring interior as a consequence of the adjustability of the length of a band of springs. That adjustable length derives from extension of the length of the band by flattening the supporting structure 40 to extend the length of the bridging portion 37, or by gathering in that supporting structure to shorten the length of the bridging portion. Thereby, the border wires in the top and bottom faces of the spring interior 21 may be located immediately above and below one another so as to present squared corners on the resulting spring interior. In this way, the endmost bridging portion of a band of springs may be severed at its mid-length point and connected to the border wire, while a full-length bridging portion is connected to a border wire in the opposite face. And, any difference in length of the bands in the two faces may be accommodated by lengthening the bridging portion 37" of the spring band located adjacent to the half-length bridging portion or, if necessary, by gathering it in to shorten it. Such lengthening or foreshortening of the supporting portion 40 may be accomplished in a single row of interconnecting segments 37, or may be located in multiple different rows of the spring interior. Additionally, such extending or foreshortening of the bridging portions of selected rows of the bands of springs may be located in one face or in both faces of the spring interior.

As a consequence of utilizing the wire of the supporting portion of the interconnecting segments of the bands of springs to connect the edgemost bands to the border wire or the endmost end portions of the interconnecting segments to the border wire, substantial savings may be made in the cost of materials to form a complete spring interior because there is no longer any need for metal clips or lacing wires to make the connection. Additionally, the wrapped, as opposed to sheet-metal clipped, connection of the bands of springs to the border wire has been found in many instances to be less noisy than sheet-metal clipped or helically laced wire connections.

While we have described only a single preferred embodiment of our invention, persons skilled in the art to which it pertains will appreciate changes and modifications which may be made without departing from the spirit of our invention. Therefore we do not intend to be limited except by the scope of the following appended claims:

We claim:

1. A bedding mattress comprising a spring interior having a plurality of bands of springs, each band of springs comprising a single length of spring wire shaped to form a plurality of individual coil springs arranged in a longitudinal row, one end turn of each coil spring lying adjacent to a top face of the band and the other end turn of each coil spring lying adjacent to a bottom face of the band, each coil spring being joined to the adjacent coil springs by interconnecting segments integral with the coil springs, one of said interconnecting segments being located substantially in the top face of the band and the other of said interconnecting segments being located substantially in the bottom face of the band, and each interconnecting segment comprising a bridging portion which extends lengthwise of the row and end portions which extend transversely of the bands from the ends of said bridging portion, the bands being disposed side by side so that their top faces lie in a top main face of the spring interior and their bottom faces lie in a bottom main face of the spring interior, the bands being interconnected by helical lacing wires lying in the top and bottom faces of the bands and extending across the bands, each helical lacing wire embracing adjacent end portions of interconnecting segments of the bands, the spring interior being characterized by each of said bridging portions being connected at the ends to said end portions of said interconnecting segments by radiused corners of substantially different radii so as to position adjacent bridging portions in substantially longitudinal alignment perpendicular to said helical lacing wires, padding overlying at least one of said main faces of said spring interior, and an upholstered covering material encasing said spring interior and said padding.

2. A spring interior having a plurality of bands of springs, each band of springs comprising a single length of spring wire shaped to form a plurality of individual coil springs arranged in a longitudinal row, one end turn of each coil spring lying adjacent to a top face of the band and the other end turn of each coil spring lying adjacent to a bottom face of the band, each coil spring being joined to the adjacent coil springs by interconnecting segments integral with the coil springs, one of said interconnecting segments being located substantially in the top face of the band and the other of said interconnecting segments being located substantially in the bottom face of the band, and each interconnecting segment comprising a bridging portion which extends lengthwise of the row and end portions which extend transversely of the bands from the ends of said bridging portions, the bands being disposed side by side so that their top faces lie in a top main face of the spring interior and their bottom faces lie in a bottom main face of the spring interior, the bands being interconnected by helical lacing wires lying in the top and bottom faces of the bands and extending across the bands, each helical lacing wire embracing adjacent end portions of interconnecting segments of the bands, the spring interior being characterized by each of said bridging portions being connected at the ends to said end portions of said interconnecting segments by radiused corners of substantially different radii so as to position adjacent bridging portions in substantially longitudinal alignment perpendicular to said helical lacing wires.

3. The spring interior of claim 2 which further comprises a border wire surrounding said spring interior in the top and bottom main faces of said spring interior, and the bridging portions of at least one edgemost band of springs being connected to said border wires in at least one of said main faces by wrapping of the laterally extending portions of a bridging portion about said border wire.

4. The spring interior of claim 2 which further comprises a border wire surrounding said spring interior in the top and bottom main faces of said spring interior, and the endmost end portions of the bands of springs being connected to the border wire in at least one of the main faces by wrapping of the endmost end portions of said bands about said border wire.

5. A spring interior having a plurality of bands of springs, each band of springs comprising a single length of spring wire shaped to form a plurality of individual coil springs arranged in a longitudinal row, one end turn of each coil spring lying adjacent to a top face of the band and the other end turn of each coil spring lying adjacent to a bottom face of the band, each coil spring being joined to the adjacent coil springs by interconnecting segments integral with the coil springs, one of said interconnecting segments being located substantially in the top face of the band and the other of said interconnecting segments being located substantially in the bottom face of the band, and each interconnecting segment comprising a bridging portion which extends lengthwise of the row and end portions which extend transversely of the bands from the ends of said bridging portions, the bands being disposed side by side so that their top faces lie in a top main face of the spring interior and their bottom faces lie in a bottom main face of the spring interior, the bands being interconnected by helical lacing wires lying in the top and bottom faces of the bands and extending across the bands, each helical lacing wire embracing adjacent end portions of interconnecting segments of the bands, at least some of the bridging portions being shaped so as to extend not only longitudinally of the bands but also laterally thereof, the laterally extending portions constituting supporting structures, each such supporting structure being itself supported solely by and cantilevered from adjacent bridging portions of the interconnecting segments of which it forms an integral part, a border wire surrounding said spring interior in each of the top and bottom main faces of the spring interior, the spring interior being characterized by the bridging portions of at least one edgemost band of springs being connected to the border wire in at least one of said main faces by wrapping of the laterally extending portions of said bridging portions about said border wire.

6. A spring interior having a plurality of bands of springs, each band of springs comprising a single length of spring wire shaped to form a plurality of individual coil springs arranged in a longitudinal row, one end turn of each coil spring lying adjacent to a top face of the band and the other end turn of each coil spring lying adjacent to a bottom face of the band, each coil spring being joined to the adjacent coil springs by interconnecting segments integral with the coil springs, one of said interconnecting segments being located substantially in the top face of the band and the other of said interconnecting segments being located substantially in the bottom face of the band, and each interconnecting segment comprising a bridging portion which extends lengthwise of the row and end portions which extend transversely of the bands from the ends of said bridging portions, the bands being disposed side by side so that their top faces lie in a top main face of the spring interior and their bottom faces lie in a bottom main face of the spring interior, the bands being interconnected by helical lacing wires lying in the top and bottom faces of the bands and extending across the bands, each helical lacing wire embracing adjacent end portions of interconnecting segments of the bands, a border wire surrounding said spring interior in each of the top and bottom main faces of the spring interior, the spring interior being characterized by the endmost end portions of the bands of springs being connected to the border wire in at least one of said main faces by wrapping of the endmost end portions of said bands about said border wire.

7. A spring interior having a plurality of bands of springs, each band of springs comprising a single length of spring wire shaped to form a plurality of individual coil springs arranged in a longitudinal row, one end turn of each coil spring lying adjacent to a top face of the band and the other end turn of each coil spring lying adjacent to a bottom face of the band, each coil spring being joined to the adjacent coil springs by interconnecting segments integral with the coil springs, one of said interconnecting segments being located substantially in the top face of the band and the other of said interconnecting segments being located substantially in the bottom face of the band, and each interconnecting segment comprising a bridging portion which extends lengthwise of the row and end portions which extend transversely of the bands from the ends of said bridging portions, the bands being disposed side by side so that their top faces lie in a top main face of the spring interior and their bottom faces lie in a bottom main face of the spring interior, the bands being interconnected by helical lacing wires lying in the top and bottom faces of the bands and extending across the bands, each lacing helical wire embracing adjacent end portions of interconnecting segments of the bands, at least some of the bridging portions being shaped so as to extend not only longitudinally of the band but also laterally thereof, the laterally extending portions constituting supporting structures, each such supporting structure being itself supported solely by and cantilevered from adjacent bridging portions of the interconnecting segments of which it forms an integral part, a border wire surrounding said spring interior in each of the top and bottom main faces of the spring interior, the spring interior being characterized by the endmost bridging portions of at least some of said bands of springs being severed at the midpoint of said endmost bridging portions and connected at the ends to one of said border wires, and others of the bridging portions of bands of springs containing said midpoint severed bridging portions having the laterally extending portions of the bridging portions altered in configuration to change the length of said others of the bridging portions to a length different from the length of bridging portions containing unaltered laterally extending portions.

8. A spring interior having a plurality of bands of springs, each band of springs comprising a single length of spring wire shaped to form a plurality of individual coil springs arranged in a longitudinal row, one end turn of each coil spring lying adjacent to a top face of the band and the other end turn of each coil spring lying adjacent to a bottom face of the band, each coil spring being joined to the adjacent coil springs by interconnecting segments integral with the coil springs, one of said interconnecting segments being located substantially in the top face of the band and the other of said interconnecting segments being located substantially in the bottom face of the band, and each interconnecting segment comprising a bridging portion which extends lengthwise of the row and end portions which extend transversely of the bands from the ends of said bridging portions, the bands being disposed side by side so that their top faces lie in a top main face of the spring interior and their bottom faces lie in a bottom main face of the spring interior, the bands being interconnected by helical lacing wires lying in the top and bottom faces of the bands and extending across the bands, each lacing helical wire embracing adjacent end portions of interconnecting segments of the bands, at least some of the bridging portions being shaped so as to extend not only longitudinally of the band but also laterally thereof, the laterally extending portions constituting supporting structures, each such supporting structure being itself supported solely by and cantilevered from adjacent bridging portions of the interconnecting segments of which it forms an integral part, a border wire surrounding said spring interior in each of the top and bottom main faces of the spring interior, the spring interior being characterized by the endmost bridging portions of at least some of said bands of springs being severed and connected at the ends to one of said border wires, and others of the bridging portions of bands of springs containing said severed bridging portions having the laterally extending portions of the bridging portions altered in configuration to change the length of said others of the bridging portions to a length different from the length of bridging portions containing unaltered laterally extending portions.

9. A spring interior comprising a plurality of longitudinally extending bands of springs disposed side by side and connected together by transversely extending helical lacing wires in the top and bottom faces of the bands, each of said bands of springs comprising a single length of wire formed into a plurality of substantially vertical coil springs interconnected by interconnecting segments of wire located alternately in the top and bottom faces of the bands, each of said interconnecting segments comprising a longitudinally extending bridging portion, end portions which extend transversely of the bands from the ends of the bridging portions, and a laterally extending portion of the bridging portion which extends transversely of the bands from a portion of the bridging portion located intermediate of the ends of the bridging portion, said spring interior being characterized by each of said bridging portions being connected at the ends to said end portions of said interconnecting segments by radiused corners of substantially different radii so as to position adjacent bridging portions in substantially longitudinal alignment perpendicular to said helical lacing wires.

10. The spring interior of claim 9 which further comprises a border wire surrounding said spring interior in the top and bottom faces of said bands, and the bridging portions of at least one edgemost band of springs being connected to said border wire in at least one of said faces by wrapping of the laterally extending portions of the bridging portions about said border wire.

11. The spring interior of claim 9 which further comprises a border wire surrounding said spring interior in the top and bottom main faces of said bands, and the endmost end portions of the bands of springs being connected to the border wire in at least one of the main faces by wrapping of the endmost end portions of said bands about said border wire.

12. A spring interior comprising a plurality of longitudinally extending bands of springs disposed side by side and connected together by transversely extending helical lacing wires in the top and bottom faces of the bands, each of said bands of springs comprising a single length of wire formed into a plurality of substantially vertical coil springs interconnected by interconnecting segments of wire located alternately in the top and bottom faces of the bands, each of said interconnecting segments comprising a longitudinally extending bridging portion, end portions which extend transversely of the bands from the ends of the bridging portions, and a support structure which extends transversely of the bands from a portion of the bridging portions located intermediate of the ends of the bridging portion, a border wire surrounding said spring interior in each of the top and bottom faces of the bands, the spring interior being characterized by the bridging portions of at least one edgemost band of springs being connected to the border wire in at least one of said faces by wrapping of the transversely extending support structure of said bridging portions about said border wire.

13. A spring interior comprising a plurality of longitudinally extending bands of springs disposed side by side and connected together by transversely extending helical lacing wires in the top and bottom faces of the bands, each of said bands of springs comprising a single length of wire formed into a plurality of substantially vertical coil springs interconnected by interconnecting segments of wire located alternately in the top and bottom faces of the bands, each of said interconnecting segments comprising a longitudinally extending bridging portion, end portions which extend transversely of the bands from the ends of the bridging portions, and a support structure which extends transversely of the bands from a portion of the bridging portions located intermediate of the ends of the bridging portion, a border wire surrounding said spring interior in each of the top and bottom bands faces of the bands; the spring interior being characterized by the endmost end portions of the bands of springs being connected to the border wire in at least one of said faces by wrapping of the endmost end portions of said bands about said border wire.

14. A spring interior comprising a plurality of longitudinally extending bands of springs disposed side by side and connected together by transversely extending helical lacing wires in the top and bottom faces of the bands, each of said bands of springs comprising a single length of wire formed into a plurality of substantially vertical coil springs interconnected by interconnecting segments of wire located alternately in the top and bottom faces of the bands, each of said interconnecting segments comprising a longitudinally extending bridging portion, end portions which extend transversely of the bands from the ends of the bridging portions, and a support structure which extends transversely of the bands from a portion of the bridging portions located intermediate of the ends of the bridging portion, a border wire surrounding said spring interior in each of the top and bottom faces of the bands, the spring interior being characterized by the endmost bridging portions of at least some of said bands of springs being severed and connected at the ends to one of said border wires, and others of the bridging portions of bands of springs containing said severed bridging portions having the laterally support structures of the bridging portions altered in configuration to change the length of said others of the bridging portions to a length different from the length of bridging portions containing unaltered transversely extending support structures.

15. The method of squaring a spring interior so as to position an upper border wire of the spring interior above and parallel to a lower border wire of the interior, which spring interior has a plurality of bands of springs, each band of springs comprising a single length of spring wire shaped to form a plurality of individual coil springs arranged in a longitudinal row, one end turn of each coil spring lying adjacent to a top face of the band and the other end turn of each coil spring lying adjacent to a bottom face of the band, each coil spring being joined to the adjacent coil springs by interconnecting segments integral with the coil springs, one of said interconnecting segments being located substantially in the top face of the band and the other of said interconnecting segments being located substantially in the bottom face of the band, and each interconnecting segment comprising a bridging portion which extends lengthwise of the row and end portions which extend transversely of the bands from the ends of said bridging portions, the bands being disposed side by side so that their top faces lie in a top main face of the spring interior and their bottom faces lie in a bottom main face of the spring interior, the bands being interconnected by helical lacing wires lying in the top and bottom faces of the bands and extending across the bands, each helical lacing wire embracing adjacent end portions of interconnecting segments of the bands, at least some of the bridging portions being shaped so as to extend not only longitudinally of the band but also laterally thereof, the laterally extending portions constituting supporting structures, each such supporting structure being itself supported solely by and cantilevered from adjacent bridging portions of the interconnecting segments of which it forms an integral part, an upper border wire surrounding said spring interior in the top main face thereof and a lower border wire in the bottom main face thereof, which method comprises severing the endmost bridging portions of at least some of the bands of springs at the midpoint of said endmost bridging portions, connecting the ends of the severed endmost bridging portions to one of said border wires, and altering the length of others of the bridging portions of the bands of springs containing said midpoint severed bridging portions by changing the configuration of the laterally extending support structures of said others of the bridging portions to thereby conform the overall length of the bands in the face having midpoint severed bridging portions to the length of the bands in the face having no midpoint severed bridging portions.

16. The method of squaring a spring interior so as to position an upper border wire of the spring interior above and parallel to a lower border wire of the interior, which spring interior has a plurality of bands of springs, each band of springs comprising a single length of spring wire shaped to form a plurality of individual coil springs arranged in a longitudinal row, one end turn of each coil spring lying adjacent to a top face of the band and the other end turn of each coil spring lying adjacent to a bottom face of the band, each coil spring being joined to the adjacent coil springs by interconnecting segments integral with the coil springs, one of said interconnecting segments being located substantially in the top face of the band and the other of said interconnecting segments being located substantially in the bottom face of the band, and each interconnecting segment comprising a bridging portion which extends lengthwise of the row and end portions which extend transversely of the bands from the ends of said bridging portions, the bands being disposed side by side so that their top faces lie in a top main face of the spring interior and their bottom faces lie in a bottom main face of the spring interior, the bands being interconnected by helical lacing wires lying in the top and bottom faces of the bands and extending across the bands, each helical lacing wire embracing adjacent end portions of interconnecting segments of the bands, at least some of the bridging portions being shaped so as to extend not only longitudinally of the band but also laterally thereof, the laterally extending portions constituting supporting structures, each such supporting structure being itself supported solely by and cantilevered from adjacent bridging portions of the interconnecting segments of which it forms an integral part, an upper border wire surrounding said spring interior in the top main face thereof and a lower border wire in the bottom main face thereof, which method comprises severing the endmost bridging portions of at least some of the bands of springs at the midpoint of said endmost bridging portions, connecting the ends of the severed endmost bridging portions to one of said border wires, and altering the length of others of the bridging portions of the bands of springs containing said severed bridging portions by changing the configuration of the laterally extending supporting structures of said others of the bridging portions to thereby conform the overall length of the bands in the face having severed bridging portions to the length of the bands in the face having no severed bridging portions.

17. The method of squaring a spring interior so as to position an upper border wire of the spring interior above and parallel to a lower border wire of the interior, which spring interior comprises a plurality of longitudinally extending bands of springs disposed side by side and connected together by transversely extending helical lacing wires in the top and bottom faces of the bands, each of said bands of springs comprising a single length of wire formed into a plurality of substantially vertical coil springs interconnected by interconnecting segments of wire located alternately in the top and bottom faces of the bands, each of said interconnecting segments comprising a longitudinally extending bridging portion, end portions which extend transversely of the bands from the ends of the bridging portions, and a support structure which extends transversely of the bands from a portion of the bridging portion located intermediate of the ends of the bridging portion, an upper border wire surrounding said spring interior in the top face thereof and a lower border wire in the bottom face thereof, which method comprises severing the endmost bridging portions of at least some of the bands of springs at the midpoint of said endmost bridging portions, connecting the ends of the severed endmost bridging portions to one of said border wires, and altering the length of others of the bridging portions of the bands of springs containing said severed bridging portions by changing the configuration of the transversely extending support structures of said others of the bridging portions to thereby conform the overall length of the bands in the face having the severed bridging portions to the length of the bands in the face having no severed bridging portions.

18. A spring interior comprising a plurality of longitudinally extending bands of springs disposed side by side and connected together by transversely extending helical lacing wires in the top and bottom faces of the bands, each of said bands of springs comprising a single length of wire formed into a plurality of substantially vertical coil springs interconnected by interconnecting segments of wire located alternately in the top and bottom faces of the bands, each of said interconnecting segments comprising a longitudinally extending bridging portion and end portions which extend transversely of the bands from the ends of the bridging portions, said spring interior being characterized by each of said bridging portions being connected at the ends to said end portions of said interconnecting segments by radiused corners of substantially different radii so as to position adjacent bridging portions in substantially longitudinal alignment perpendicular to said helical lacing wires.

19. A spring interior comprising a plurality of longitudinally extending bands of springs disposed side by side and connected together by transversely extending helical lacing wires in the top and bottom faces of the bands, each of said bands of springs comprising a single length of wire formed into a plurality of substantially vertical coil springs interconnected by interconnecting segments of wire located alternately in the top and bottom faces of the bands, each of said interconnecting segments comprising a longitudinally extending bridging portion and end portions which extend transversely of the bands from the ends of the bridging portions, the end portions of adjacent interconnecting segments being laced together by one of said transversely extending helical lacing wires, said end portions of adjacent interconnecting segments emerging from opposite sides of a helical lacing wire transversely spaced apart a distance equal to one-half pitch of that helical lacing wire, and said spring interior being characterized by each of the bridging portions of a longitudinally extending band of springs being generally in colinear alignment and having the axes of all coils of springs in each band of springs generally in vertical alignment when viewed longitudinally of the band.

20. The spring interior of claim 19 which is further characterized by having the opposite end portions of each interconnecting segment differ in configuration.

21. The spring interior of claim 19 which is further characterized by having the opposite end portions of each of said interconnecting segments radiused, but differing in radius at the point of connection of the opposite end portions to the bridging portion of said interconnecting segments.

* * * * *

UNITED STATES PATENT AND TRADEMARK OFFICE

CERTIFICATE OF CORRECTION

PATENT NO. : 4,942,636

DATED : July 24, 1990

INVENTOR(S) : Terence A. Scott and Chester R. Yates

It is certified that error appears in the above-identified patent and that said Letters Patent is hereby corrected as shown below:

Column 14, lines 9 and 10, change "the laterally extending portions of a bridging portion" to read -- a laterally extending portion of the bridging portions --

Column 17, line 11, after "bottom" delete -- main -- .

Column 17, line 55, after "bottom" delete -- bands -- .

Column 17, line 55, change ";" to -- , -- .

Signed and Sealed this

Sixteenth Day of March, 1993

*Attest:*

STEPHEN G. KUNIN

*Attesting Officer*

*Acting Commissioner of Patents and Trademarks*